US011046498B2

(12) United States Patent
Liao et al.

(10) Patent No.: US 11,046,498 B2
(45) Date of Patent: Jun. 29, 2021

(54) M-TYPE INFLATABLE BAG

(71) Applicant: KUNSHAN AIRBAG PACKING CORP, Kunshan (CN)

(72) Inventors: Kao-Hsiung Liao, Kunshan (CN); Ping-Yuan Liao, Kunshan (CN)

(73) Assignee: KUNSHAN AIRBAG PACKING CORP, Kunshan (CN)

( * ) Notice: Subject to any disclaimer, the term of this patent is extended or adjusted under 35 U.S.C. 154(b) by 24 days.

(21) Appl. No.: 16/536,403

(22) Filed: Aug. 9, 2019

(65) Prior Publication Data

US 2020/0047970 A1 Feb. 13, 2020

(30) Foreign Application Priority Data

Aug. 13, 2018 (TW) ..... 107128238

(51) Int. Cl.
*B65D 81/05* (2006.01)

(52) U.S. Cl.
CPC ..... *B65D 81/052* (2013.01)

(58) Field of Classification Search
CPC ..... B65D 81/052; B65D 81/05; B65D 81/051
USPC ..... 206/522, 586, 583
See application file for complete search history.

(56) References Cited

U.S. PATENT DOCUMENTS 8,714,356 B2 * 5/2014 Liao ..... B65D 81/052 206/522
8,973,756 B2 * 3/2015 Liao ..... B65D 81/022 206/522
9,174,788 B2 * 11/2015 Liao ..... B65D 81/052
9,745,113 B2 * 8/2017 Yoshifusa ..... B65D 81/054

FOREIGN PATENT DOCUMENTS

CN 105197413 A 12/2015
WO 2016/202313 A2 12/2016

OTHER PUBLICATIONS

Taiwan Patent Office, Office Action, Patent Application Serial No. TW107128238, dated Nov. 29, 2018.

* cited by examiner

*Primary Examiner* — Steven A. Reynolds
(74) *Attorney, Agent, or Firm* — Rabin & Berdo, P.C.

(57) ABSTRACT

An M-type inflatable bag includes a bottom wall, two side walls, two protective walls and two connecting portions. The bottom wall includes a plurality of bottom gas columns. Each of the side walls includes a plurality of side gas columns. Each side wall is located on two opposite sides of the bottom wall. The side walls and the bottom wall are divided at a joint to form a receiving space and a limiting space. The protective walls include a plurality of protective gas columns, and the protective walls are separately located outside the side walls. The connecting portion includes a plurality of first heat sealing nodes adjacent to the side wall and a plurality of second heat sealing nodes adjacent to the bottom wall. When the side wall and the bottom wall are bent, a buffer bump is formed between a first virtual bending line and a second virtual bending line.

9 Claims, 7 Drawing Sheets

M-TYPE INFLATABLE BAG

CROSS-REFERENCE TO RELATED APPLICATION

This non-provisional application claims priority under 35 U.S.C. § 119(a) to Patent Application No. 107128238 filed in Taiwan, R.O.C. on Aug. 13, 2018, the entire contents of which are hereby incorporated by reference.

BACKGROUND

Technical Field

A packing bag, and in particular, to a bag with a shockproof function and an airtight type.

Related Art

Logistics transportation has become an indispensable field in modern society. For the transportation of goods, in addition to the requirements for fast, the protection of the transported goods is also quite demanding. For example, requirements for shockproof, cushioning, and waterproofing of packing materials.

With the development of science and technologies, electronic objects are moving toward a trend of thinness and lightness, and they are mainly based on large sizes. Therefore, shockproof, cushioning, and waterproofing are more important for packing materials.

The traditional shock-absorbing packing material provides limited shockproof and cushioning effects, and the protection and space for accommodating a conveying object does not completely match the volume of the conveying object. This makes the shockproof, and cushioning effect greatly reduced.

SUMMARY

An embodiment in the present invention provides an M-type inflatable bag, including: a bottom wall, two side walls, two protective walls, and two connecting portions.

The bottom wall includes a plurality of bottom gas columns; each of the side walls includes a plurality of side gas columns, each side wall is located on two opposite sides of the bottom wall, and each side wall includes a first side and a second side that are opposite to each other; the side gas columns adjacent to the first side of the side walls include a limiting gas column, a volume of the limiting gas column is less than that of the other side gas columns, and the opposite limiting gas columns are adhered to each other, and the side walls and the bottom wall are divided at a joint to form a receiving space and a limiting space; and the protective walls include a plurality of protective gas columns, where the protective walls are separately located outside the side walls.

One side of the two connecting portions is connected to the side wall, and the other side is connected to the bottom wall, and each of the connecting portion includes: a plurality of first heat sealing nodes and a plurality of second heat sealing nodes. The plurality of first heat sealing nodes is adjacent to the side wall, and the first heat sealing nodes may form a first virtual bending line; the plurality of second heat sealing nodes is adjacent to the bottom wall, and the second heat sealing nodes may form a second virtual bending line, and the second virtual bending line does not intersect the first virtual bending line; where each of the side walls is bent along the first virtual bending line, and the bottom wall is bent along the second virtual bending line; a buffer bump hull is formed between the first virtual bending line and the second virtual bending line; two sides of the buffer bump respectively abut against the side wall and the bottom wall, so that the side wall and the bottom wall are adjacent to each other and do not squeeze each other.

According to the M-type inflatable bag described above, in an embodiment, the limiting gas columns include two micro gas columns.

The M-type inflatable bag described above, in an embodiment, further includes an adhesion member disposed between the side wall and the protective wall to adhere the side wall and the protective wall.

The M-type inflatable bag described above, in an embodiment, further includes two connecting walls, where each connecting wall includes a plurality of connecting gas columns, each of the connecting walls is located on an upper side of the side wall and the protective wall, and two sides of the connecting wall are connected to the side wall and the protective wall.

The M-type inflatable bag described above, in an embodiment, further includes a diaphragm disposed in the receiving space, where two sides of the diaphragm are adhered to the side wall, and divide the receiving space into a first space and a second space.

According to the M-type inflatable bag described above, in an embodiment, the diaphragm includes a plurality of rib structures, where each of the rib structures is generated by adhesion, at a heat sealing point, between the diaphragm and a heat sealing line between the adjacent side gas columns.

According to the M-type inflatable bag described above, in an embodiment, a bottom of each of the protective walls is flush with a plane in which the bottom wall is located.

According to the M-type inflatable bag described above, in an embodiment, a bottom of each of the protective walls protrudes from a plane in which the bottom wall is located.

According to the M-type inflatable bag described above, in an embodiment, a joint between the bottom wall and each side wall includes a plurality of first heat sealing nodes spaced apart and a plurality of second heat sealing nodes spaced apart. The first heat sealing nodes form the first heat sealing line, the second heat sealing nodes form the second heat sealing line, and the first heat sealing line does not intersect the second heat sealing line.

According to the M-type inflatable bag described above, in an embodiment, in the first side, the protective wall forms a hole with a bottom of the side wall.

The M-type inflatable bag provided by at least one embodiment of the present invention has an effective cushioning external force impact and absorbs shock force. In addition, in an embodiment, because a structure of the M-type inflatable bag includes a limiting gas column, therefore, the distance between the side walls is not magnified by the extension of the side wall. That is, the limiting gas column provides a function of making the two side walls retract inward, and the two maintain a distance. In this way, the M-type inflatable bag can match the structure of the conveying object. The M-type inflatable bag is located on the conveying object or to accommodate the conveying object, providing good protection without loose, and can solve the problems encountered by the previous technology.

DETAILED DESCRIPTION

Figure 1:
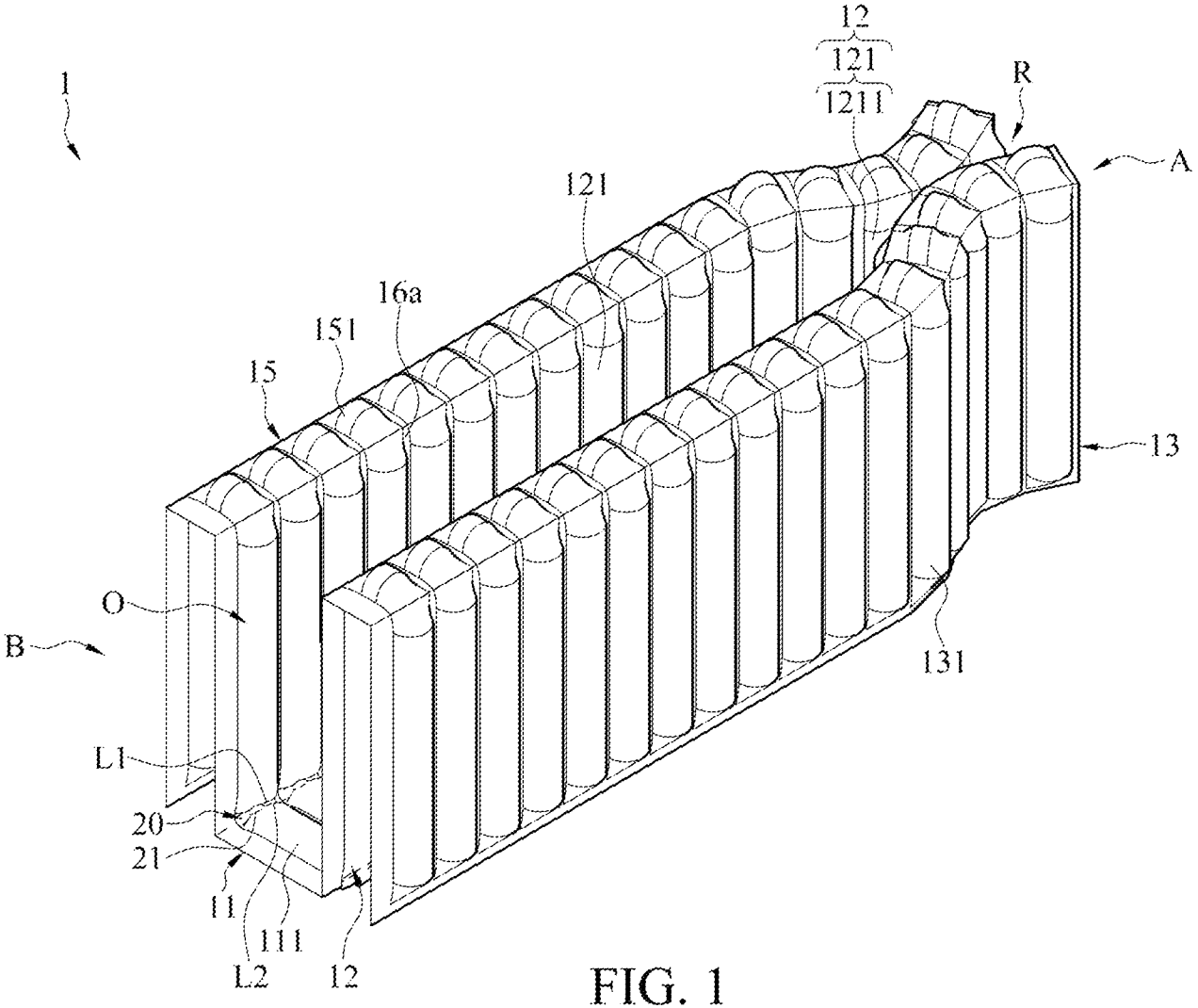
FIG. 1 is an appearance schematic diagram of an M-type inflatable bag according to an embodiment of the present invention.

FIG. 1 is an appearance schematic diagram of an M-type inflatable bag 1 according to an embodiment of the present invention. The M-type inflatable bag 1 includes a bottom wall 11, two side walls 12, and two protective walls 13.

In some embodiments, the M-type inflatable bag 1 can be stacked by a plurality of diaphragms, formed by heat sealing means, inflatable formation, and has a heat sealing line 16*a* between the gas columns.

The bottom wall 11 includes a plurality of bottom gas columns 111. Each of the side walls 12 includes a plurality of side gas columns 121. Each side wall 12 is located on two opposite sides of the bottom wall 11, and each side wall 12 includes a first side A and a second side B that are opposite to each other. The side gas columns 121 adjacent to the first side A of the side walls 12 include a limiting gas column 1211. The volume of the limiting gas column 1211 is less than that of the other side gas columns 121, and the opposite limiting gas columns 1211 are adhered to each other. With this structure in an extension direction of the side wall 12, the distance between the two side walls 12 is smaller than the saturation of the limiting gas column 1211 compared with the other side gas column 121, which can effectively shrink the two side walls 12, not causing the two side walls 12 in the extension direction, the distance between the two expands outward.

In an embodiment, the opposite limiting gas columns 1211 are adhered by the heat sealing line 16*a*, or in other manners such as glue. The side walls 12 and the bottom wall 11 are divided at a joint of the limiting gas columns 1211 to form a receiving space O and a limiting space R, The receiving space O can be socketed to the conveying object. The present invention is not limited thereto. Based on the above, the limiting gas column 1211 has a function of causing the side wall 12 to retract, so that the socket can be matched with the conveying object. However, in the limiting space R, the surrounding side wall 12 (and the protective wall 13) unfolds a corner area that can be held against the box.

The protective wall 13 includes a plurality of protective gas columns 131, and the protective walls are respectively located outside the side walls. The protective wall 13 may be disposed on the outer side of each side wall 12 in an additional manner, or may be in a heat sealing manner to bond the upper side of the protective wall 12 with the upper side of the side wall 12, and the outer side is folded, that is, can be located on the outside of the side wall 12 while protecting the internal side wall 12 and the socked conveying object. In an embodiment, the conveying object is an electronic panel, the M-type inflatable bag 1 is socked on the corner of the electronic panel.

Figure 2:
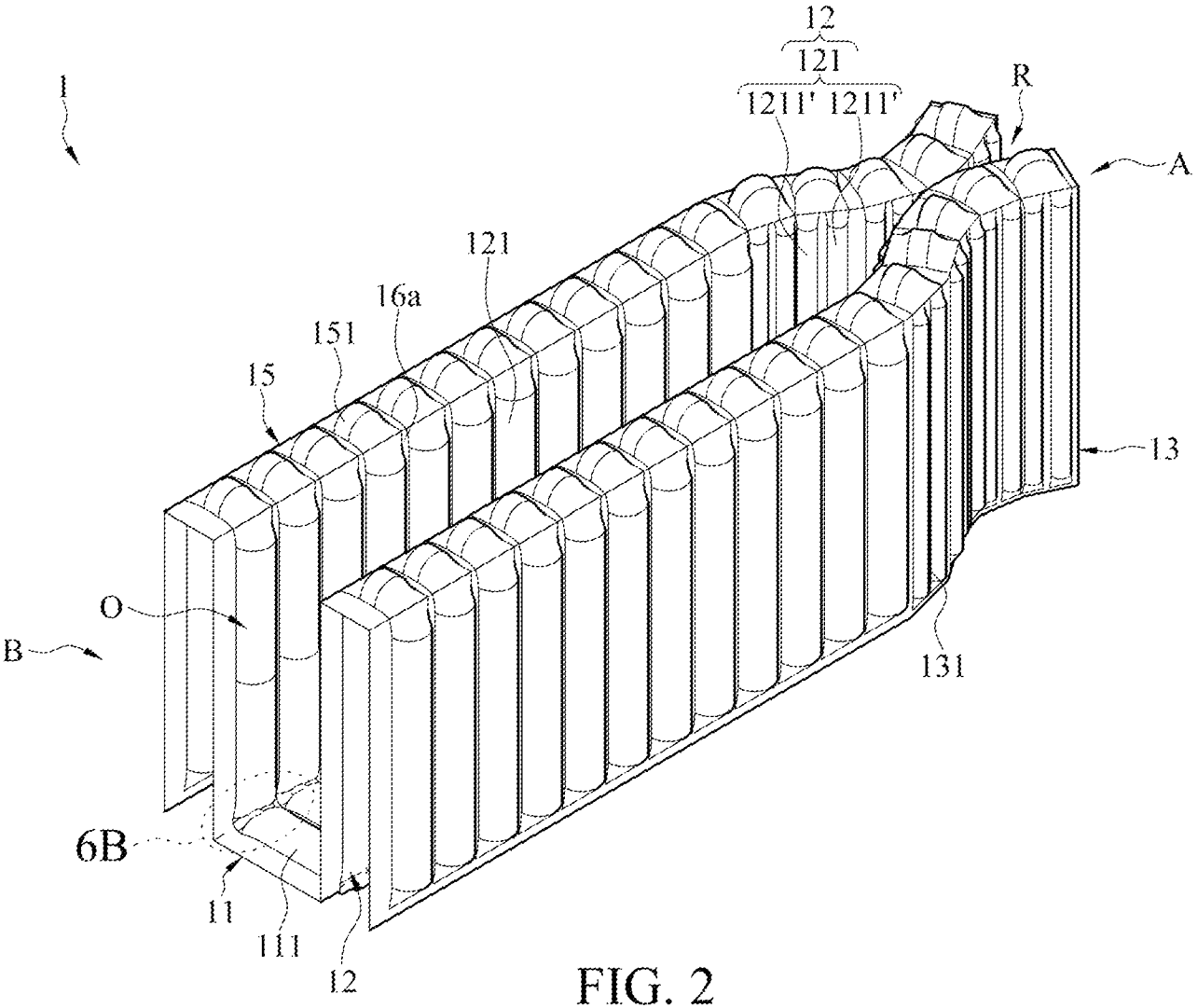
FIG. 2 is an appearance schematic diagram of an M-type inflatable bag according to an embodiment of the present invention.

FIG. 2 is an appearance schematic diagram of an M-type inflatable bag 1 according to an embodiment of the present invention. In this embodiment, limiting gas columns 1211 include two micro gas columns 1211'. In addition to the manner of making the volume of the limiting gas column 1211 less than that of the other side gas columns 121, the two side walls 12 may also be prevented, in the manner of the two micro gas columns 1211', from expanding outward in the extension direction.

In some embodiments, to make the structure of the M-type inflatable bag 1 more stable, the M-type inflatable bag 1 further includes an adhesion member, configured between the side wall 12 and a protective wall 13, bonding the side wall 12 and the protective wall 13, and making it stable. The adhesion member can be a heat sealing point of the heat sealing, a heat sealing line 16*a*, or in a manner of applying an adhesive (adhesive layer) to bond the side wall 12 and the protective wall 13.

Referring to FIG. 1 again, in this embodiment, two connecting walls 15 are further included. The connecting wall 15 includes a plurality of connecting gas columns 151. Each of the connecting walls 15 is located an upper side of the side wall 12 and the protective wall 13, and two sides of the connecting wall 15 are connected to the side wall 12 and the protective wall 13. In some embodiments, the M-type inflatable bag 1 is added independently, combined with side wall 12 and protective wall 13. In other some embodiments, the side wall 12 and the protective wall 13 are originally stacked by a plurality of diaphragms, formed by means of heat sealing, after applying a heat sealing line 16*a* to the joint between the side wall 12 and the protective wall 13 and then folding outward. However, in this embodiment, the two heat sealing lines 16*a* are disposed by heat sealing to form a connecting gas column 151, which can facilitate the folding of the protective wall 13. That is, the present invention does not limit the manner in which the protective wall 13 is disposed outside the side wall 12.

In some embodiments, the shape of the protective gas column 131 may correspond to the limiting gas column 1211 or the micro gas column 1211'. That is, during the production of the M-type inflatable bag, the structure of the protective gas column 131 can further be designed such as the same as the limiting gas column 1211 or the micro gas column 1211', so that in the overlapping, folding structure, can be more tight, and reduce the overall volume of the M-type inflatable bag 1.

Figure 3:
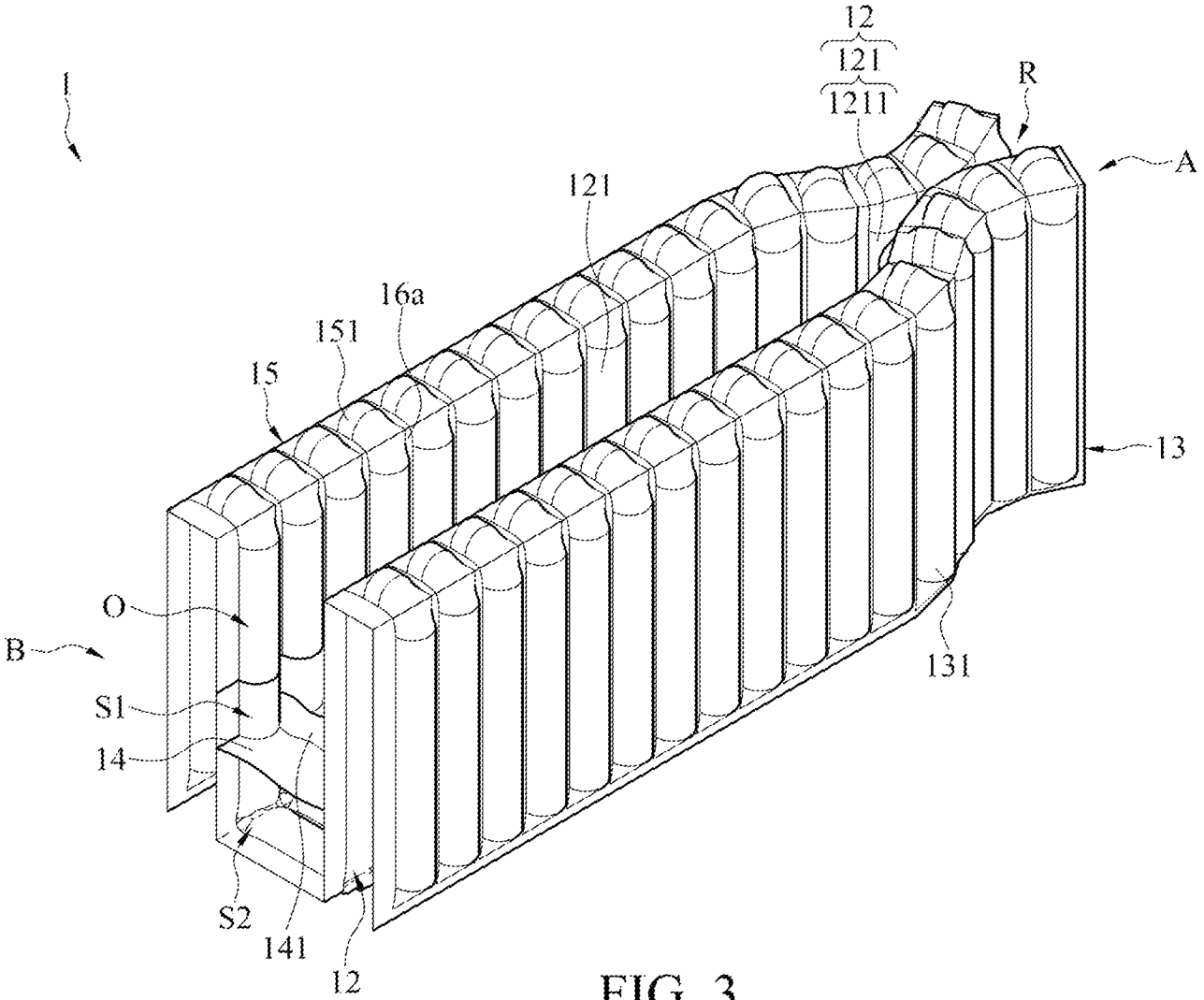
FIG. 3 is an appearance schematic diagram of an M-type inflatable bag according to an embodiment of the present invention.
Figure 4:
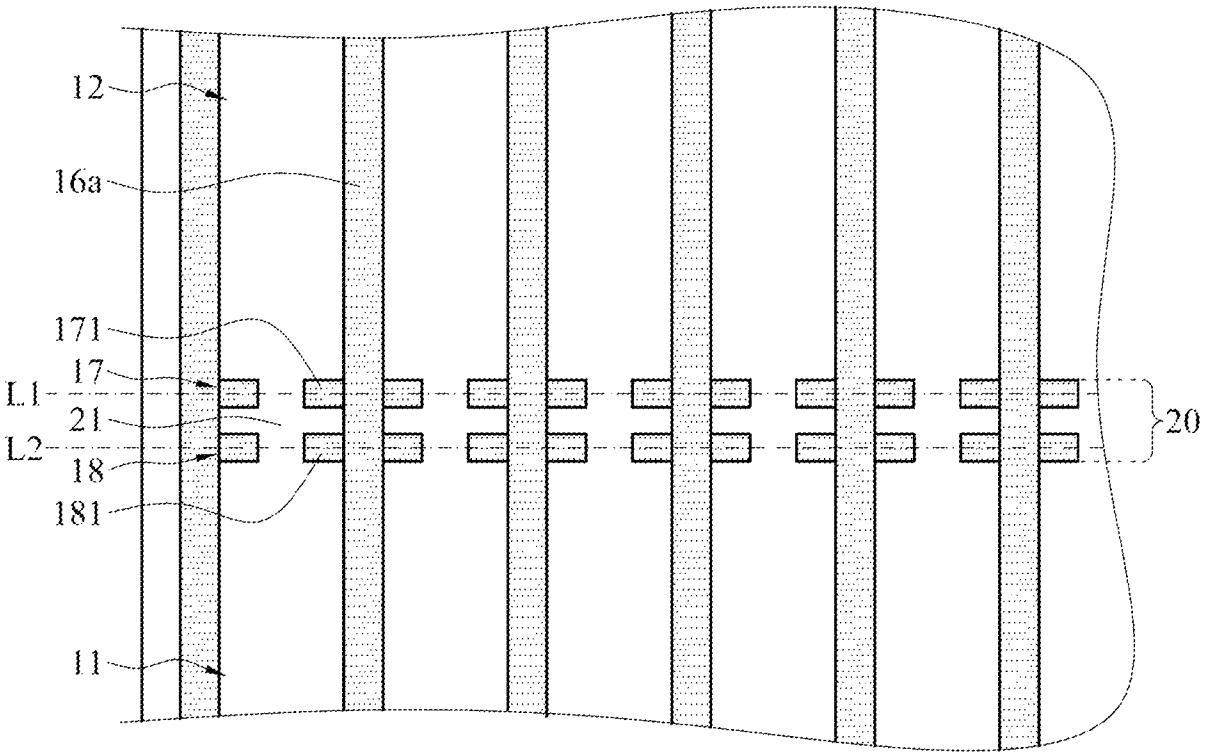
FIG. 4 is a partial schematic diagram of an uninflated state of an M-type inflatable bag according to an embodiment of the present invention.

FIG. 3 is an appearance schematic diagram of an M-type inflatable bag 1 according to an embodiment of the present invention. In this embodiment, the M-type inflatable bag 1 further includes a diaphragm 14 disposed on the receiving space O, two sides of the diaphragm 14 are bonded with the side wall 12, and divides the receiving space O into a first space S1 and a second space S2. Based on this structure, the shock absorption and cushioning effects of the M-type inflatable bag can be increased. However, in this embodiment, the diaphragm 14 includes a plurality of rib structures 141, each of the rib structures 141 is generated by a heat sealing line 16*a* between the diaphragm 14 and each adjacent side gas column 121, which is bonded by a heat sealing point. The rib structure 141 can increase the grip between the M-type inflatable bag 1 and the conveying object, however, the present invention does not limit the way in which the diaphragm 14 is added to the receiving space O.

In some embodiments, a bottom of each of the protective walls 13 is flush with a plane in which the bottom wall 13 is located. However, in other some embodiments, the bottom of each of the protective walls 13 protrudes from a plane in which the bottom wall 11 is located. That is, the present invention does not limit the height of the protective wall 13, and uses different height of the protective wall 13 depending on the needs of an operator or a user and the consideration of the cushioning effect.

Figure 5:
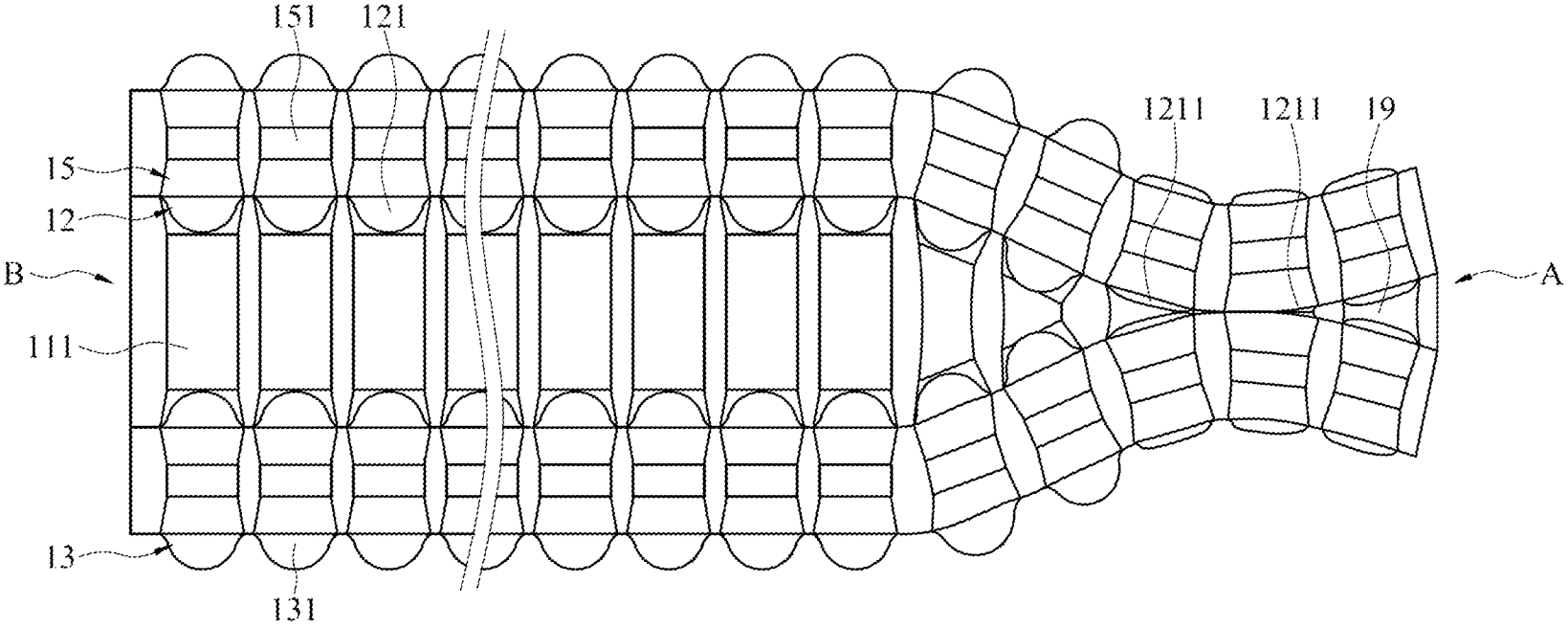
FIG. 5 is a top schematic view of an M-type inflatable bag according to an embodiment of the present invention.
Figure 6B:
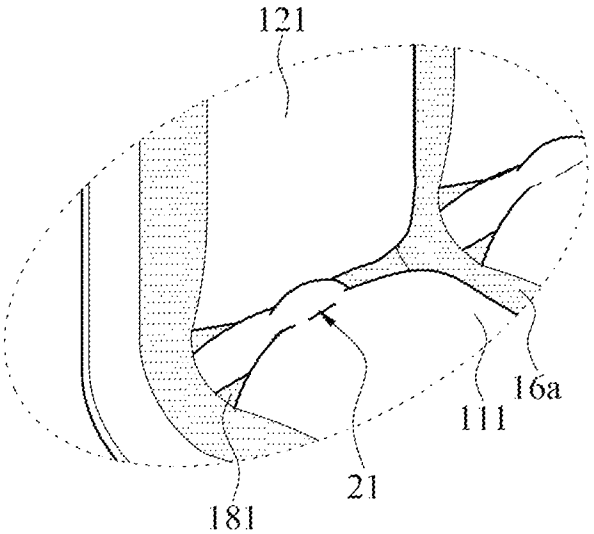
FIG. 6B is a partial schematic diagram of an embodiment 6B shown in FIG. 2.
Figure 6A:
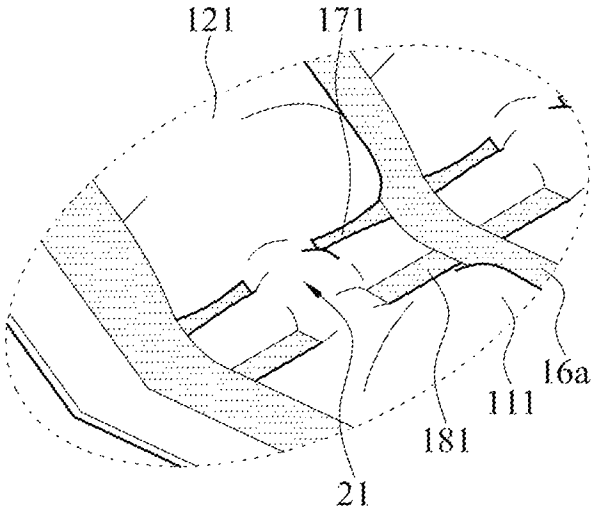
FIG. 6A is a partial schematic diagram of an unsaturated state of an M-type inflatable bag according to an embodiment of the present invention.
Figure 6C:
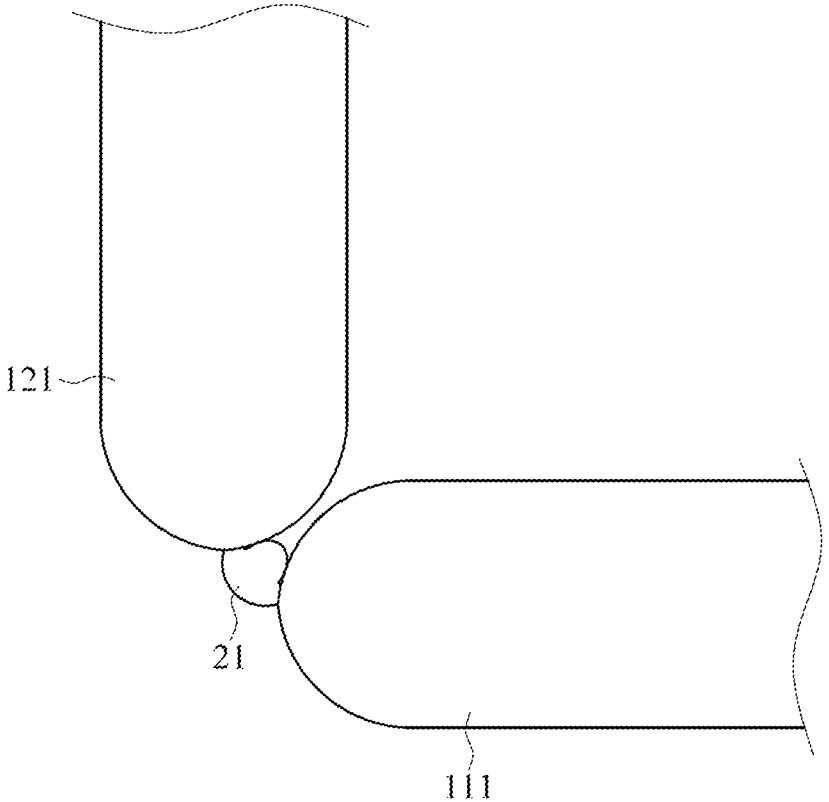
FIG. 6C is a partial side view of an unsaturated state of an M-type inflatable bag according to an embodiment of the present invention.

Referring to FIG. 4 to FIG. 6C, FIG. 4 is a partial schematic diagram of an M-type inflatable bag according to an embodiment of the present invention, FIG. 6A is a partial schematic diagram of an unsaturated state of an M-type inflatable bag according to an embodiment of the present invention, FIG. 6B is a partial schematic diagram of an embodiment 6B shown in FIG. 2, and FIG. 6C is a partial side view of an unsaturated state of an M-type inflatable bag according to an embodiment of the present invention.

One side of a connecting portion 20 is connected to the side wall 12, and the other side is connected to the bottom wall 11. In this embodiment, a joint between the bottom wall 11 and each side wall 12 includes a plurality of first heat sealing nodes 171 spaced apart and a plurality of second heat sealing nodes 181 spaced apart. The first heat sealing nodes 171 may form a first heat sealing line L1, and the second heat sealing nodes may form a second heat sealing line L2. When each of the side walls 12 is bent along the first virtual bending line L1, and each of the bottom walls 11 is bent along the second virtual bending line L2, a buffer bump 21 is formed between the first virtual bending line L1 and the second virtual bending line L2, two sides of the buffer bump 21 respectively abut against the side wall 12 and the bottom wall 11, so that the side wall 12 and the bottom wall 11 are adjacent to each other and do not squeeze each other. Based on this structure, the structure of the side wall 12 and the bottom wall 11 can be stabilized, so that the angle of the connection between the side wall and the bottom wall 11 is a right angle shape, so that it can more closely offset the border of the conveying object.

FIG. 5 is an appearance schematic diagram of an M-type inflatable bag 1 according to an embodiment of the present invention. In this embodiment, in the first side A, a protective wall 13 forms a hole 19 with a bottom of the side wall 12. After the M-type inflatable bag 1 packing the conveying object, the conveying object will be boxed, during a delivery preparation stage, the operator will have a box binding procedure, the hole 19 is reserved in the binding process to accommodate the nail (through the box) space. Therefore, the body of the shockproof packing material and the conveying object may not be hurt.

At least one embodiment of the present invention, because the structure of the M-type inflatable bag includes the limiting gas column, the distance between the side walls is not expanded outwards due to the extension of the side wall. That is, the limiting gas column provides a function of making the two side walls retract inward, and the two maintain a distance. In this way, the M-type inflatable bag can match the structure of the conveying object. The M-type inflatable bag is set up on the conveying object or to accommodate the conveying object, providing good protection without loosening, and providing effective cushioning force impact, and the ability to absorb shock.

What is claimed is:

1. An M-type inflatable bag, comprising:

a bottom wall, comprising a plurality of bottom gas columns;

two side walls, each comprising a plurality of side gas columns, wherein each side wall is located on two opposite sides of the bottom wall, and each side wall comprises a first side and a second side that are opposite to each other, wherein the side gas columns adjacent to the first side of the side walls comprise a limiting gas column, a volume of the limiting gas column is less than that of the other side gas columns, and the opposite limiting gas columns are adhered to each other, and the side walls and the bottom wall are divided at a joint of the limiting gas columns to form a receiving space and a limiting space;

two protective walls, comprising a plurality of protective gas columns, wherein the protective walls are separately located outside the side walls; and two connecting portions, wherein one side of each of the connecting portions is connected to the side wall, and the other side thereof is connected to the bottom wall, each of the connecting portions comprising:

a plurality of first heat sealing nodes, adjacent to the side wall, wherein the first heat sealing nodes form a first virtual bending line; and a plurality of second heat sealing nodes, adjacent to the bottom wall, wherein the second heat sealing nodes form a second virtual bending line, and the second virtual bending line does not intersect the first virtual bending line, wherein each of the side walls is bent along the first virtual bending line, and the bottom wall is bent along the second virtual bending line, a buffer bump is formed between the first virtual bending line and the second virtual bending line, and the buffer bump is convex toward the receiving space, two sides of the buffer bump respectively abut against the side wall and the bottom wall, so that the side wall and the bottom wall are adjacent to each other and do not squeeze each other.

2. The M-type inflatable bag according to claim 1, wherein the limiting gas columns comprise two micro gas columns.

3. The M-type inflatable bag according to claim 1, further comprising an adhesion member, disposed between the side wall and the protective wall to adhere the side wall and the protective wall.

4. The M-type inflatable bag according to claim 1, further comprising two connecting walls, wherein each connecting wall comprises a plurality of connecting gas columns, each of the connecting walls is located on an upper side of the side wall and the protective wall, and two sides of the connecting wall are connected to the side wall and the protective wall.

5. The M-type inflatable bag according to claim 1, further comprising a diaphragm disposed in the receiving space, wherein two sides of the diaphragm are adhered to the side wall, and divide the receiving space into a first space and a second space.

6. The M-type inflatable bag according to claim 5, wherein the diaphragm comprises a plurality of rib structures, each of the rib structures is generated by adhesion, at a heat sealing point, between the diaphragm and a heat sealing line between the adjacent side gas columns.

7. The M-type inflatable bag according to claim 1, wherein a bottom of each of the protective walls is flush with a plane in which the bottom wall is located.

8. The M-type inflatable bag according to claim 1, wherein a bottom of each of the protective walls protrudes from a plane in which the bottom wall is located.

9. The M-type inflatable bag according to claim 1, wherein in the first side, the protective wall forms a hole with a bottom of the side wall.

* * * * *